US005546674A

United States Patent [19]

Lange et al.

[11] Patent Number: 5,546,674

[45] Date of Patent: Aug. 20, 1996

[54] AIR-MOVING APPLIANCE FOR DRYING OR STYLING HAIR

[75] Inventors: Klaus-Peter Lange, Eppstein; Peter Janouch, Linsengericht, both of Germany

[73] Assignee: Braun Aktiengesellschaft, Kronberg, Germany

[21] Appl. No.: 424,252

[22] PCT Filed: Oct. 15, 1993

[86] PCT No.: PCT/EP93/02848

§ 371 Date: Apr. 24, 1995

§ 102(e) Date: Apr. 24, 1995

[87] PCT Pub. No.: WO94/09669

PCT Pub. Date: May 11, 1994

[30] Foreign Application Priority Data

Oct. 24, 1992 [DE] Germany ..... 42 36 036.6

[51] Int. Cl.[6] ..... A45D 20/12

[52] U.S. Cl. ..... 34/97; 34/99

[58] Field of Search ..... 34/96, 97, 98, 34/99, 90, 91, 283

[56] References Cited

U.S. PATENT DOCUMENTS

| | | | |
|---|---|---|---|
| D. 349,585 | 8/1994 | Rizzuto, Jr. | D28/18 |
| 2,827,060 | 3/1958 | Marty | 132/9 |
| 4,232,454 | 11/1980 | Springer | 34/97 |
| 4,430,808 | 2/1984 | Toyomi et al. | 34/97 |
| 4,936,027 | 6/1990 | Tsuji | 34/90 |
| 5,212,366 | 5/1993 | McDougall | 34/97 |

FOREIGN PATENT DOCUMENTS

| | | |
|---|---|---|
| 0103205 | 3/1984 | European Pat. Off. . |
| 0487933A2 | 6/1992 | European Pat. Off. . |
| 2529809 | 1/1977 | Germany . |

*Primary Examiner*—John T. Kwon
*Attorney, Agent, or Firm*—Edward S. Podszus

[57] ABSTRACT

The invention is directed to an air-moving appliance for drying or styling hair, comprising a housing 12 having an air inlet opening and an air outlet opening, with a supporting structure 30 which is provided with apertures 32 and hair pickup elements 34 being attachable to the housing at the forward end of the air outlet opening. Associated with the supporting structure 30 is a diaphragm device 36, with the supporting structure 30 being arranged at the forward end of the air outlet opening so as to be displaceable relative to the housing 12. Part of the apertures 32 of the supporting structure is closable by viture of the diaphragm device. The displacement of the supporting structure 30 is accomplished by the force exerted on the hair pickup elements 34 during the hair drying or hair styling action.

54 Claims, 6 Drawing Sheets

AIR-MOVING APPLIANCE FOR DRYING OR STYLING HAIR

Figure 1:
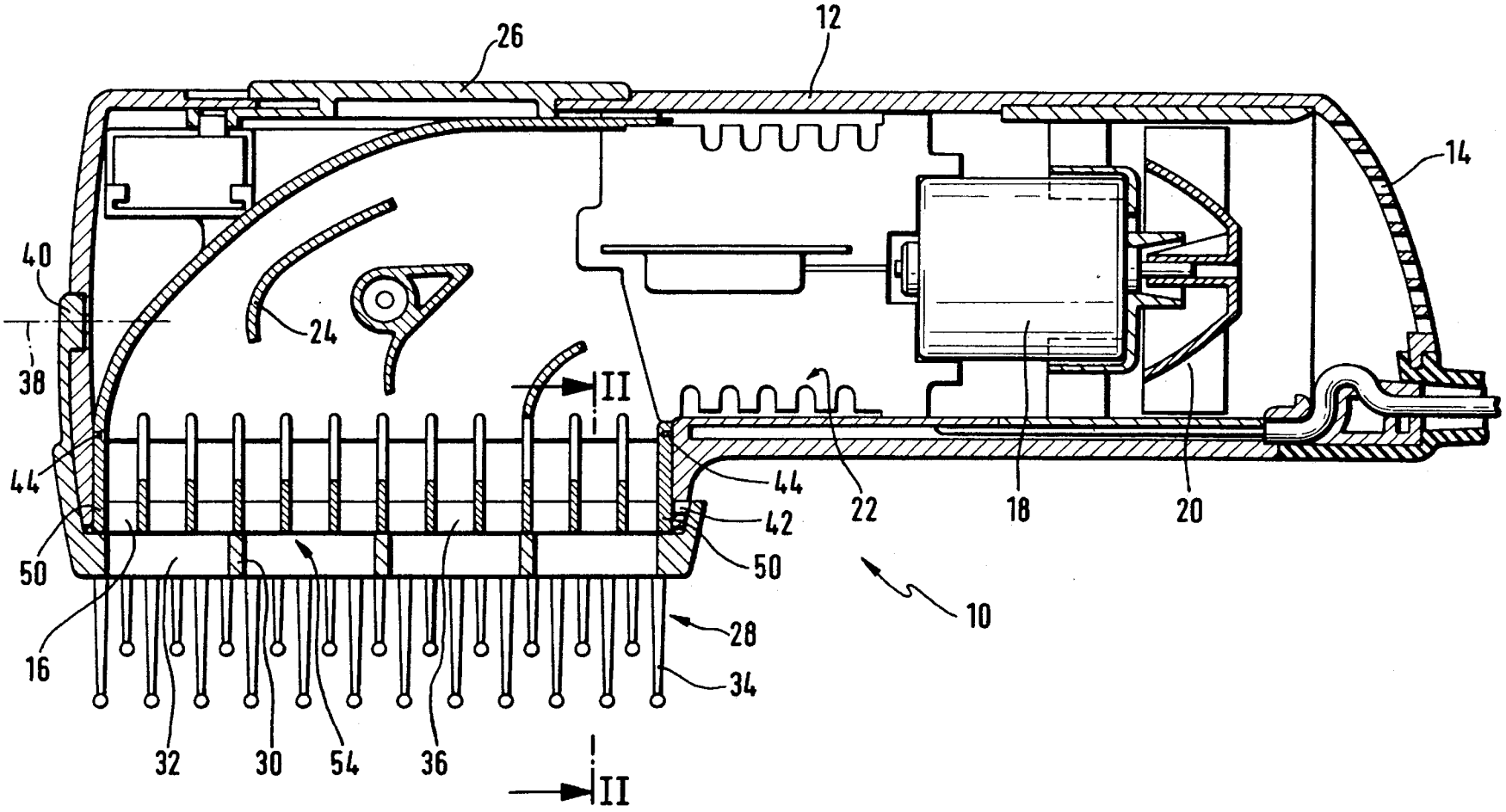

This invention relates to an air-moving appliance for drying or styling hair, comprising a housing having an air inlet opening and an air outlet opening, with a supporting structure which is provided with apertures and hair pickup means as, for example, bristles, teeth or the like, being attachable to the housing at the forward end of the air outlet opening.

An appliance of this type appears, for example, from EP 0 103 205 B1 of common assignment whose disclosure content is incorporated in the present application by express reference. This disclosure provides in the area of the outlet opening of a hair dryer two guide grooves for engagement with claws disposed on a brush, enabling the brush to be attached to the forward end of the outlet opening of the hair dryer. The brush includes bristles secured to cross members which are in turn connected to a frame of the brush bottom. The frame includes two lateral rails between which a longitudinal ridge extends which is connected to the cross members and to the narrow sides of the frame. The support carrying the bristles or teeth of the brush thus includes apertures through which the air exiting from the outlet opening of the hair dryer flows, thus enabling the appliance to be employed for drying or styling hair, the styling action being performed in particular with the brush attached. While this known appliance has proven to be successful in practical use, some applications make it desirable that the drying action be directed at selected hair strand sections, in particular in the area close to the scalp.

From DE 25 29 809 A1 a hair dryer is known in which the exiting air can be directed through a comb-like hollow structure. This device is intended to conduct the hot air in such a fashion that it penetrates the hair optimally without impinging upon the user's scalp. The hollow teeth through which air flows can be provided with a manually adjustable air guide, thus causing the exiting air stream to be discharged through either the lower or the upper area of a hollow tooth, depending on the adjustment of the air guide. In a further embodiment of this device, the position of the air guide can also be determined by the face of gravity acting thereon. While to applicant's knowledge this device has never been put into practice as a commercially available product, the device also has the disadvantage of presenting a high risk of personal injury, in addition to being extremely awkward to handle. An improvement of the hair drying or hair styling action is not actually accomplishable in practical use of this appliance.

It is an object of the present invention to improve upon an appliance of the type initially referred to in such a manner as to enable selected sections of hair to be dried or styled by means of air-moving appliances while at the same time affording ease of manipulation thereof.

In an appliance incorporating the features initially referred to, this object is essentially accomplished in that a diaphragm device is associated with the supporting structure, and that the supporting structure is arranged at the forward end of the air outlet opening so as to be displaceable relative to the housing, with part of the apertures of the supporting structure being closable by means of the diaphragm device, and the displacement of the supporting structure being accomplishable by the force exerted on the hair pickup means during the hair drying or hair styling action. These arrangements enable selected regions of the hair to be dried or styled. In particular, drying in the hair root area is possible to impart body to the hair. In the process, the stream of hot air is directed past the scalp, preventing the scalp from being exposed to an uncomfortably high temperature. As the hair pickup means penetrate the hair and the appliance is turned about its longitudinal axis, the supporting structure on which the hair pickup means are provided is initially fixed in place due to the resistance of the hair. The subsequent combing or brushing action effects a pivotal or rotary motion, accordingly a displacement of the supporting structure relative to the appliance, with a diaphragm device closing in the process a selected part of the apertures of the supporting structure. Passing through the open apertures, the exiting air stream is then directed at selected regions of the hair. Depending on the brushing or combing direction, that is, either from the left to the right or from the right to the left, the symmetry of the arrangement has the effect of causing one part of the apertures in the supporting structure to be closed automatically, while directing the exiting air stream through the other, open part of the apertures, striking selected sections of the hair for drying or styling. The manipulation of the appliance of the present invention is extremely easy, obviating the requirement of having to operate additional switches or controls to be able to dry selected regions of the hair, because the diaphragm device adjusts itself automatically depending on the combing or brushing direction. The appliance is suitable for both left and right handed users alike.

In an embodiment of the present invention, the supporting structure is operatively associated with a spring means steadying the supporting structure relative to the housing in a position of rest. By this means it is possible to fix the supporting structure in place relative to the housing of the appliance during periods of non-use. However, also when in use, the appliance can be utilized to advantage as a conventional hair dryer provided that the hair pickup means are maintained out of engagement with the hair. In such use, the diaphragm device is not actuated, thus permitting the air to pass through all of the apertures of the supporting structure, impinging upon the hair to be styled or dried.

Because the supporting structure is pivotally mounted on the housing about a pivot axis, a particularly advantageous displacement of the supporting structure relative to the housing results which is adapted for the brushing or combing operation. However, also a linear or any other displacement of the supporting structure relative to the housing may prove advantageous in particular applications.

In a further advantageous embodiment, the diaphragm device is fixedly held on the housing, forming a screen for the air outlet opening. The diaphragm device thus provides not only for closing part of the apertures of the supporting structure in dependence upon the latter's displacement, but also prevents the user from contacting current-carrying parts of the appliance. Moreover, this embodiment affords a particular straightforward construction and consequently economy of manufacture because it requires the provision of only one movable component, that is, the supporting structure itself. The diaphragm device is a component formed fast with the appliance, being disposed thereon immovably.

According to another advantageous embodiment of the present invention, the diaphragm device includes at least two diaphragm elements movable independently of each other and operatively associated with each other by means of the spring means. This embodiment suggests itself particularly if the number of apertures in the supporting structure exceeds a specified value, and if too much throttling of the air stream exiting from the appliance as the supporting structure is displaced is not desirable. Owing to the provision of independently movable diaphragm elements, it is possible also under these conditions to ensure, by suitable control means, a sufficiently strong air stream with the supporting structure displaced.

Advantageously, the at least two diaphragm elements are arranged on the appliance, in particular on the supporting structure, so as to be movable relative to the supporting structure and relative to the housing. This enables the diaphragm elements to be controlled individually during displacement of the supporting structure. Because the supporting structure includes engaging means and the housing includes abutment means for the diaphragm elements for the purpose of their alternate and opposite movement—depending on the direction in which the supporting structure is displaced—, it is possible to obtain a controlled closing action of part of the apertures of the supporting structure in dependence upon the direction in which the supporting structure is displaced.

In a particularly advantageous further development of the present invention, the diaphragm device is comprised of a diaphragm portion fixedly located on the housing and of preferably two diaphragm elements movable independently of each other and disposed in front of the diaphragm portion. By virtue of the cooperative relation between the diaphragm portion and the diaphragm elements, it is possible to accomplish an alternate opening and closing of individual air outlet openings of the diaphragm portion so that the air flows selectively through individual apertures of the supporting structure, without providing parts of a diaphragm device on the supporting structure itself. This enables the supporting structure to be varied in a multiplicity of ways with regard to, for example, the number of apertures provided for the brush, making the use of a wide variety of brush members possible.

Advantageously, the diaphragm portion fixedly located on the housing forms a screen for the air outlet opening.

In an advantageous embodiment of the present invention, the diaphragm elements are arranged on the appliance, in particular on the diaphragm portion, so as to be movable relative to the housing, relative to the diaphragm portion, as well as relative to the supporting structure. As a result of the individual movability of the diaphragm elements, they are in a position to effect a highly variable control of the air streams.

In an advantageous further development of the present invention, the supporting structure includes engaging means and the diaphragm portion includes abutment means for the diaphragm elements for the purpose of their alternate and opposite movement in the direction of displacement of the supporting structure. Depending on whether the supporting structure is in its initial or rest position or in its displaced position, the diaphragm elements, on registering with the diaphragm portion, are thus in a position to allow the air to be discharged almost unhindered or to cover individual air exit openings of the diaphragm portion, whereby the air is prevented from passing through individual apertures of the supporting structure, directing the air stream accurately toward selected hair regions.

Advantageously, the supporting structure is adapted to be immovably secured to the housing by means of a locking device.

In a further embodiment of the present invention, the supporting structure is demountable from the housing, in particular for cleaning purposes.

In order to perform a particularly intensive drying action on the hair in the root area, a further solution includes the provision of a displaceable air directing device for controlling the air stream, the device being displaceable by the force exerted on the hair pickup means.

In an advantageous embodiment, the air directing device is configured in two parts, comprising the air outlet screen as well as at least one movable diaphragm element, with the diaphragm element being movable by the supporting structure. The combing or brushing motion causes a pivotal motion of the supporting structure, thereby displacing the at least one movable diaphragm element relative to the air outlet screen and alternately closing the air outlet openings of the screen depending on the combing or brushing direction, thereby effecting control of the air stream exiting through the apertures in the supporting structure.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summarization in the claims or their back-references.

Figure 2A:
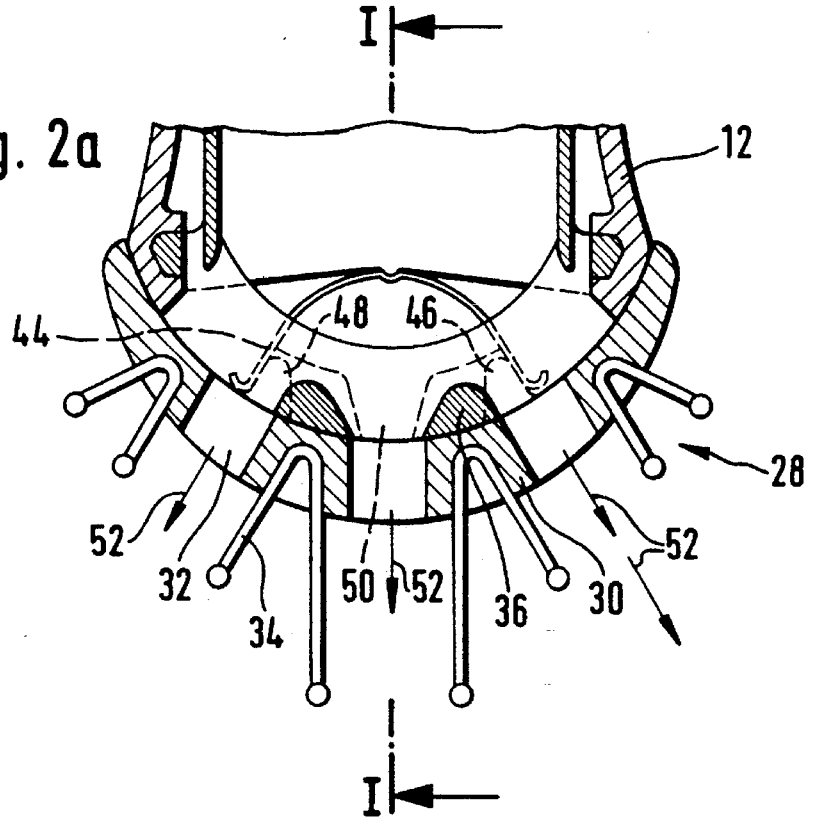
Figure 3:
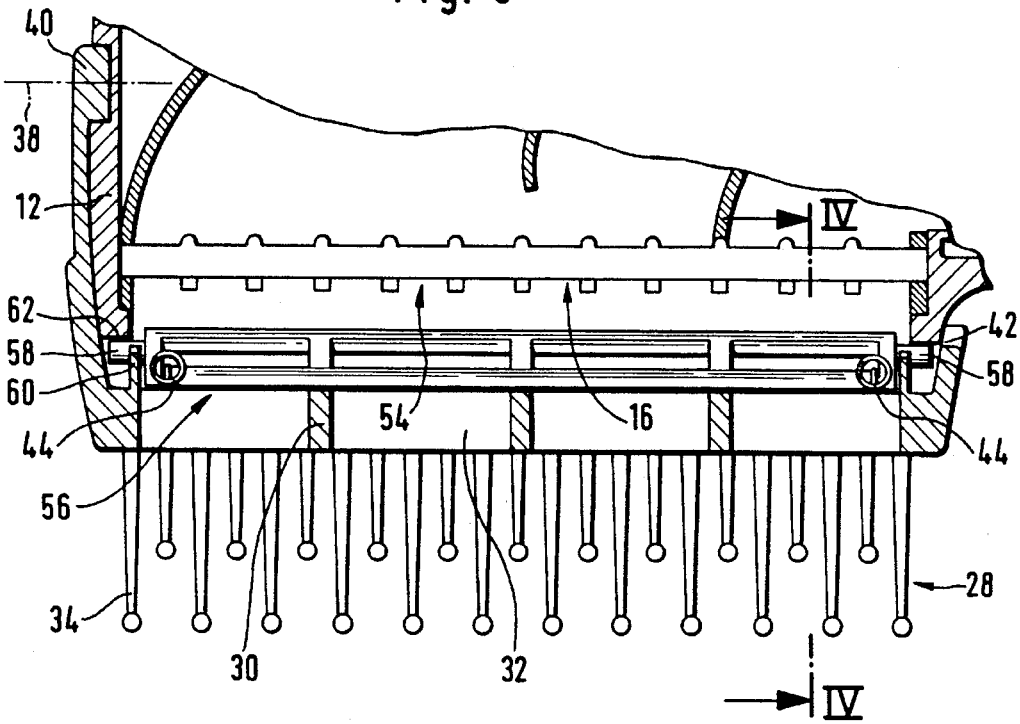
Figure 4A:
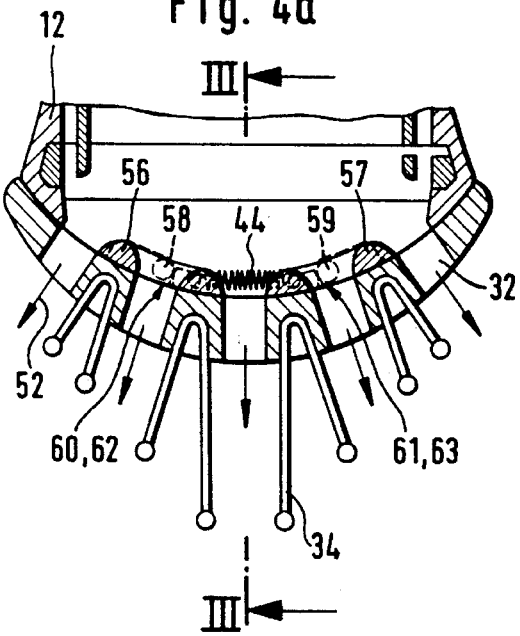
Figure 4B:
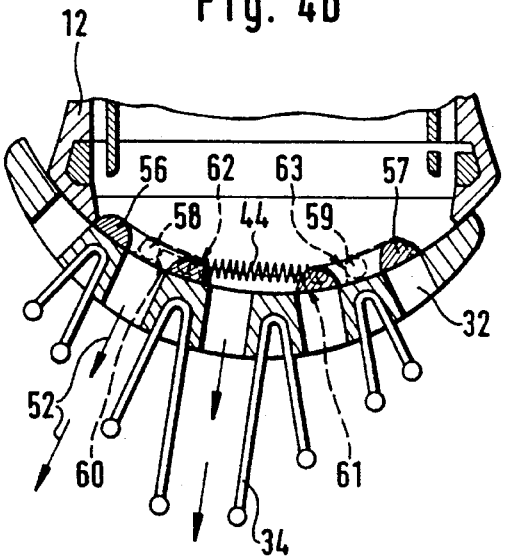
Figure 5A:
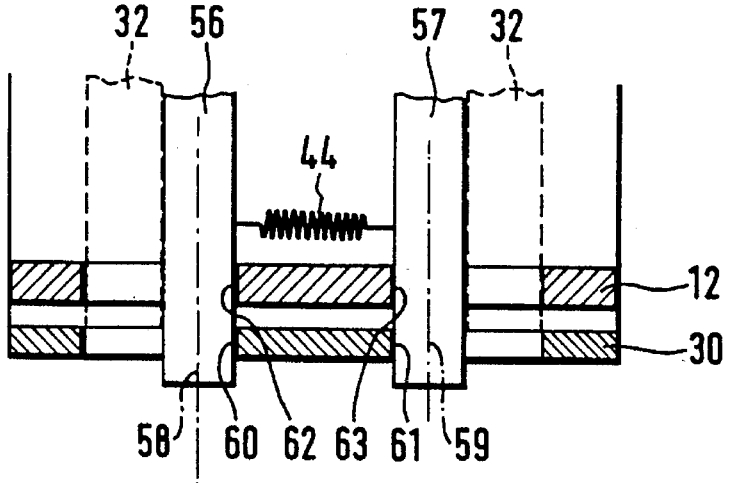
Figure 6:
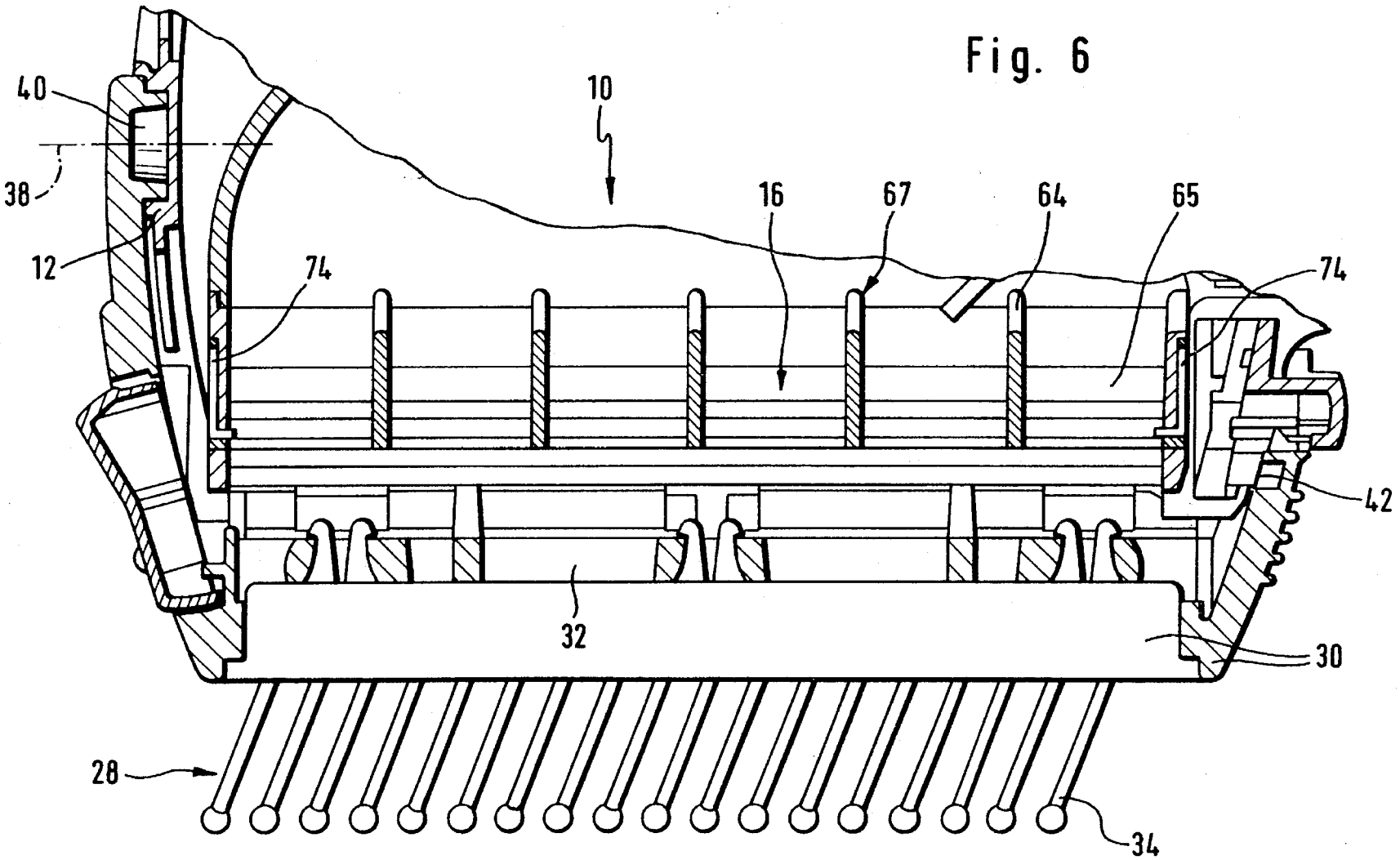
Figure 7A:
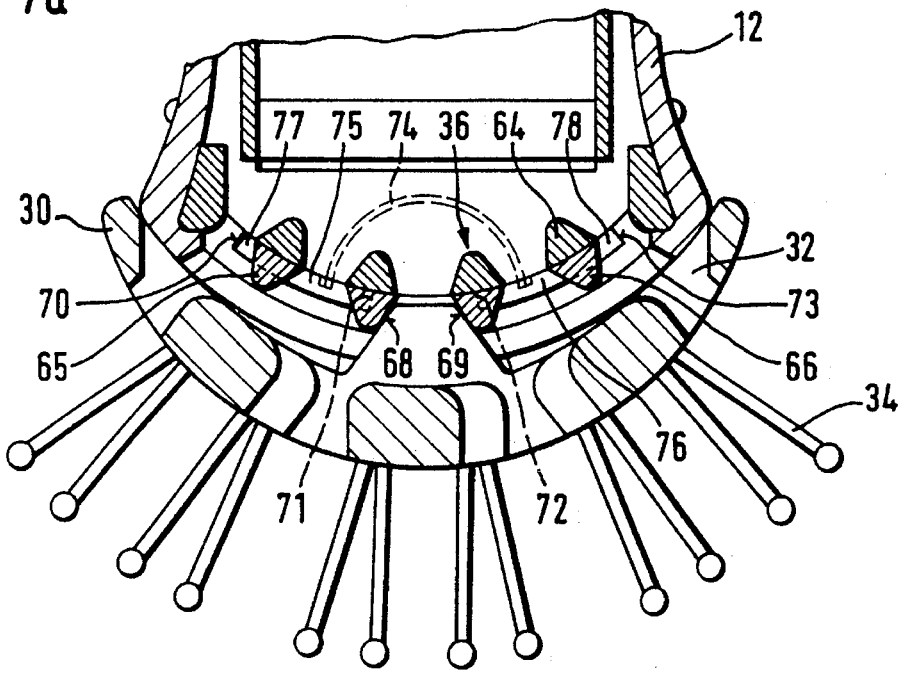

In the drawings,

FIG. 1 is a longitudinal sectional view of the air-moving appliance illustrating a first embodiment of the invention;

FIGS. 2*a, b* are partial sectional views of the appliance, taken along the line II—II of FIG. 1, showing the supporting structure in the position of rest and, respectively, a displaced position;

FIG. 3 is a partial longitudinal sectional view of the appliance of the invention illustrating a second embodiment of the invention;

FIGS. 4*a, b* are partial sectional views of the appliance, taken along the line IV—IV of FIG. 3, showing the supporting structure in the position of rest and, respectively, a displaced position;

FIGS. 5*a, b, c* are schematic diagrams to explain the mode of function of the second embodiment of FIGS. 3 and 4;

FIG. 6 is a partial longitudinal sectional view of the appliance of the invention illustrating a third embodiment of the invention; and FIGS. 7*a, b* are partial sectional views of the appliance of FIG. 6, showing the supporting structure in the position of rest and, respectively, a displaced position.

Referring to the Figures, there is shown an air-moving appliance 10 for drying or styling hair. The appliance comprises a housing 12 having an air inlet opening 14 and an air outlet opening 16. Disposed in the area of the air inlet opening 14 is an electric motor 18 driving an impeller 20. The air moved by the impeller 20 travels past a heating means 22, exiting the appliance 10 through the air outlet opening 16. Arranged between the heating means 22 and the air outlet opening 16 are air-directing means 24 which aid in deflecting the air stream at approximately right angles to the longitudinal axis of the housing. A switch 26 may be provided to adjust the heating power of the heating means 22 and the rotational frequency of the electric motor 18. A brush 28 or a comb is disposed on the appliance 10 in the area of the air outlet opening 16. The brush 28 or the comb is comprised of a supporting structure 30 in which apertures 32 are provided. The supporting structure 30 includes on its side remote from the air outlet opening 16 hair pickup means 34 as, for example, bristles or teeth. The apertures 32 are slotted openings in parallel and, where applicable, serial arrangement.

A diaphragm device 36 is associated with the side of the supporting structure 30 close to the air outlet opening 16.

The supporting structure 30 is displaceable, being in particular pivotally mounted on the housing 12 of the appliance 10 about a pivot axis 38 by means of two bearings 40, 42. In this arrangement, the supporting structure 30 is operatively associated with a spring means 44 which serves the function of steadying the supporting structure 30 relative to the housing 12 in a position of rest (FIGS. 2*a*, 4*a*, 5*a*).

Figure 2B:
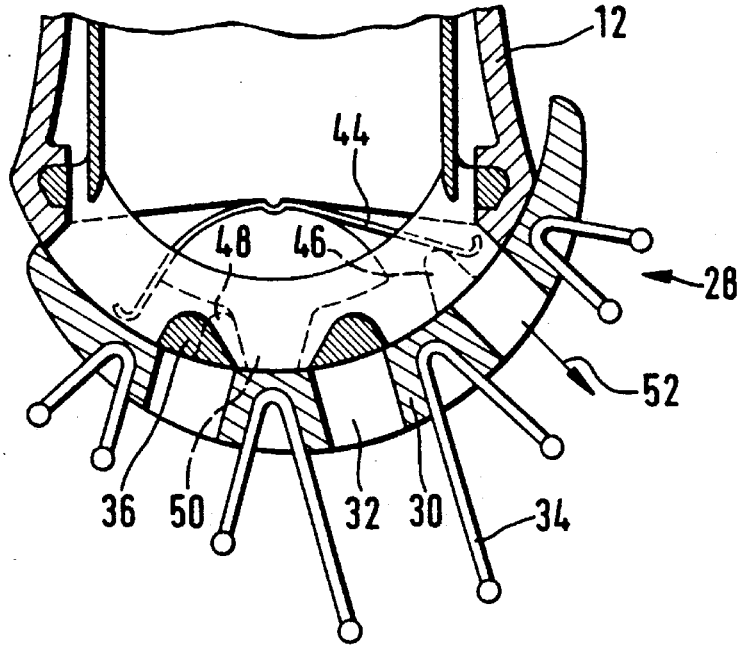

According to the first embodiment of the present invention illustrated in FIGS. 1 and 2, the supporting structure 30 includes three parallel slotted apertures 32 which may be interrupted in the direction of their longitudinal extent by smaller cross members. The diaphragm device 36 associated with this supporting structure 30 is comprised of two longitudinal rib members connected fast with the housing 12 and forming a screen 54 for the air outlet opening 16. The spring means 44 is configured as a bent leaf spring fixed in place on the housing 12. The end portions of the legs of the leaf spring act on two cams integrally formed with the supporting structure 30 (FIG. 2*a*), thereby biasing the supporting structure 30 in the position of rest. The supporting structure 30 is displaceable from this position of rest in opposition to the spring force by a specified pivot angle which is limitable by cooperation of the cams 46, 48 with a stop cam 50 formed fast with the housing. Whilst in the position of rest (FIG. 2*a*) all of the apertures 32 of the supporting structure 30 are open, allowing passage of the air stream 52 therethrough, a displacement of the supporting structure 30 to the right (FIG. 2*b*) or to the left (not shown in the drawings) produces the effect that two of the three apertures 32 are closed by means of the diaphragm device 36, so that the air stream 52 can only be discharged through the third open aperture 32.

The displacement of the supporting structure 30 occurs as a result of the force exerted on the hair pickup means 34 during the hair drying or hair styling action, causing the aperture 32 lying rearwards of the combing or brushing direction to be open. In the combing or brushing operation in which the appliance 10 is turned about its longitudinal axis after the hairs are caught by the hair pickup means 34, it is precisely this open aperture 32 that reaches a position relative to the hair to be dried or styled, such that the air stream brushes essentially over the hair root area, the exiting air stream 52 being directed substantially parallel to the user's scalp.

In the second embodiment of the present invention illustrated in FIGS. 3 and 4, the diaphragm device 36 includes two diaphragm elements 56, 57 movable independently of each other and operatively associated with each other by means of the spring means, in particular a spiral spring. Each of the diaphragm elements 56, 57 is comprised of two interconnected longitudinal rib members providing a clearance therebetween. In this embodiment, the supporting structure 30 includes five slotted apertures 32. The end portions of the diaphragm elements 56, 57 are configured as pins 58, 59, with the supporting structure 30 providing engaging means 60, 61 and the housing 12 providing abutment means 62, 63 for the pins 58, 59 of the diaphragm elements 56, 57. Depending on the direction of displacement of the supporting structure 30, one of the diaphragm elements 56, 57 is movable alternately and in opposite direction to the other diaphragm element 57, 56.

Figure 5B:
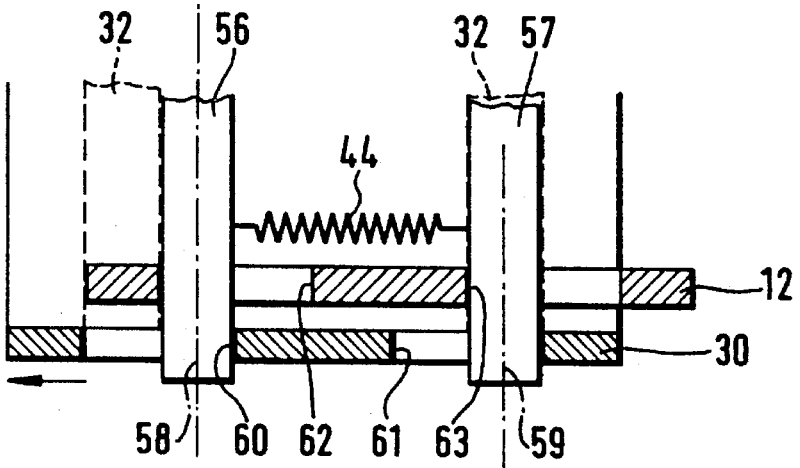
Figure 5C:
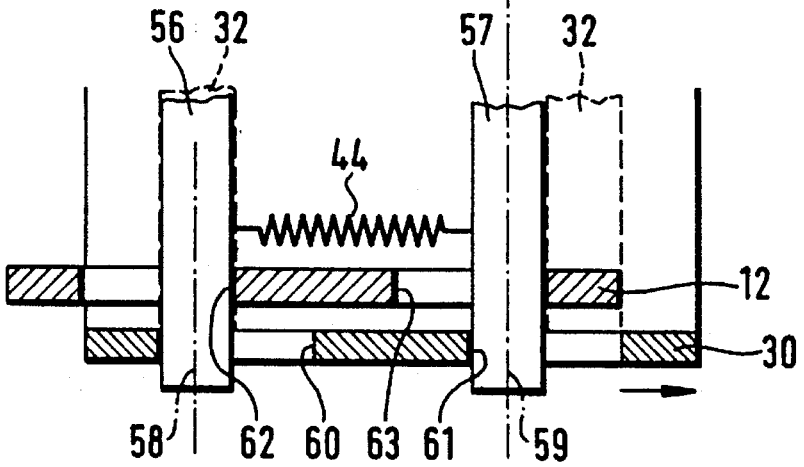

The mode of function of the embodiment of FIGS. 3 and 4 is illustrated schematically in FIG. 5. In this Figure, like reference numerals refer to comparable parts. In FIG. 5*a*, the supporting structure 30 is shown in the position of rest (FIG. 4*a*) relative to the housing 12. The supporting structure 30 is moved into the position of rest by virtue of the spring force of the spring means 44 disposed between the diaphragm elements 56 and 57. The diaphragm elements 56, 57 act on the engaging means 60, 61 of the supporting structure 30, thus exerting a restoring force on the supporting structure 30. When the engaging means 60, 61 of the supporting structure 30 register with the abutment means 62, 63 of the housing 12, the supporting structure 30 is in its position of rest. When a force is exerted through the hair pickup means 34, displacing the supporting structure 30 to the left (FIG. 5*b*), the apertures 32 in the supporting structure 30 will experience a shifting motion corresponding to this displacement. The same applies to the diaphragm element 56 which is equally displaced by the engaging means 60 of the supporting structure 30. Only the diaphragm element 57 retains its position during such displacement, so that the associated aperture 32 is closed by the diaphragm element 57. In the event of a displacement in the opposite direction as shown in FIG. 5*c*, the diaphragm element 57 is displaced by virtue of the action of the engaging means 61, and the associated aperture 32 is equally displaced, so that this aperture 32 remains open. In contrast thereto, the diaphragm element 56 does not alter its position relative to the position of rest (FIG. 5*a*), causing the aperture 32 associated with the diaphragm element 56 to move in front of the diaphragm element 56 and to be closed by it. From this it becomes apparent that, depending on the displacement of the supporting structure 30 as a result of the force acting on the hair pickup means during the brushing or combing action, part of the apertures is closed and opened alternately, thus enabling the exiting air stream 52 to be directed at selected sections of the hair. No additional switch means are required for control, because control is performed by the force or by the direction of the force acting on the hair pickup means 34.

The supporting structure 30 is immovably securable to the housing 12 by means of a locking device, for example. For this purpose, a switch slide disposed on the housing 12 and including a cam may be inserted into a groove provided on the supporting structure 30, thereby preventing a pivotal motion of the supporting structure 30. The supporting structure 30 is demountable from the housing 12, which is accomplished, for example, in that a pin of the supporting structure 30 is swung out of its engagement with the bearing eye of the bearing 40.

Figure 7B:
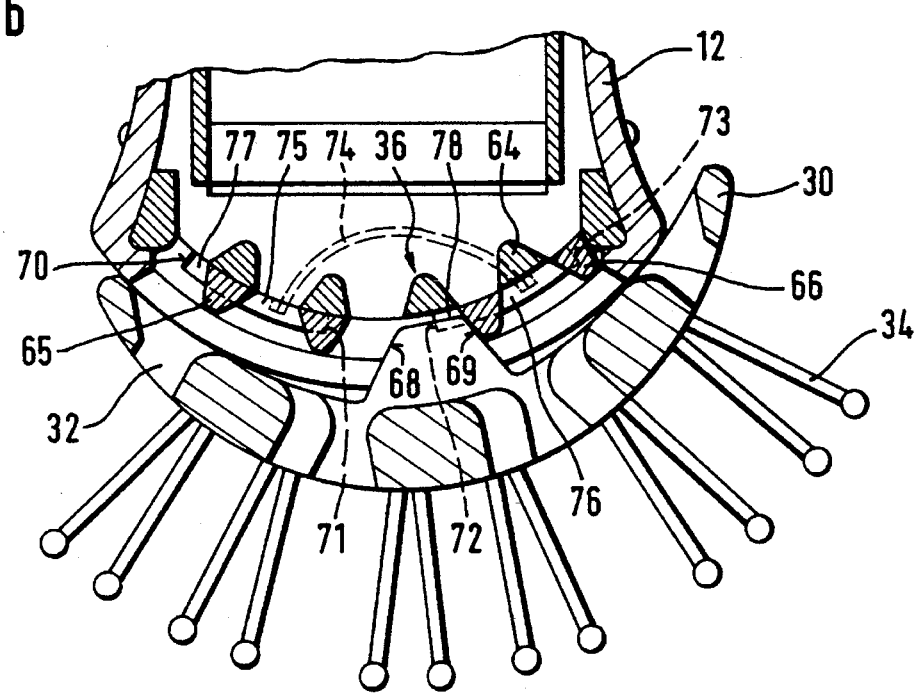

A third embodiment of the present invention is illustrated in FIGS. 6 and 7. Also in this embodiment, the brush 28 is formed by the supporting structure 30 which includes apertures 32 and carries on the side remote from the air outlet opening 16 hair pickup means 34 in the form of bristles or teeth. The diaphragm device 36 is comprised of a diaphragm portion 64 fixedly located on the housing 12 and of at least two diaphragm elements 65, 66 movable independently of each other. The diaphragm portion 64 is comprised of four longitudinal rib members providing a screen 67 for the air outlet opening 16. The possibility exists to increase or reduce the number of longitudinal rib members, their number depending on the desired extent of variation of the air stream. The diaphragm elements 65, 66 are each comprised of two interconnected longitudinal rib members providing a clearance therebetween, it being understood that the total number of longitudinal rib members as well as the number of diaphragm elements 65, 66 being not restricted to the embodiment described. At their respective end portions, the diaphragm elements 65,66 include crescent-shaped guiding means 75, 76 enabling a guiding function to be accomplished within a slotted opening 77, 78 of the diaphragm portion 64. The diaphragm elements 65, 66 are mounted in front of the diaphragm portion 64, that is, they are arranged between the diaphragm portion 64 and the supporting structure 30, being biased in their position of rest by means of a spring means 74.

The supporting structure 30 preferably includes four slotted apertures 32 and is mounted on the housing 12 of the appliance 10 by means of two bearings 40, 42 enabling the supporting structure to pivot from a position of rest about a pivot axis 38. In its position of rest which corresponds to the initial position, the supporting structure 30 is biased by the spring means 74. The spring means 74 is fixed in place on the housing 12, bearing against it. The bent ends of the spring means 74 act on the diaphragm elements 65, 66. Depending on the displacement of the supporting structure 30, the diaphragm elements 65, 66 are movable by reason of the cooperative relation between engaging means 68, 69 of the supporting structure 30 and abutment means 70, 71, 72, 73 of the housing 12, such movement being alternate and in opposite direction to the respective other diaphragm element 65, 66. The range of movement is limited by the dimensions of the slotted openings 77, 78.

In the position of rest (FIG. 7*a*), air is allowed to flow through all of the apertures 32. To perform a styling action, when the bristles or teeth of the appliance 10 are engaged within the hair and a light pressure is exerted, the combing or brushing motion will result in the supporting structure 30 displacing the diaphragm elements 65, 65 alternately and in opposite direction to the respective other diaphragm element 65, 66, depending on the brushing or combing direction. This is accomplished by the engaging means 68, 69 of the supporting structure 30 engaging behind the diaphragm elements 65, 66. As a result, the diaphragm elements 65, 66 are displaced from their initial position against the force of the spring means 74, causing displacement of the spring means 74, and following termination of the combing or brushing operation, the action of the spring tension then returns them to the position of rest, with the spring bias becoming effective in the initial position of the diaphragm elements 65, 66.

As a result of the alternate displacement of the diaphragm elements 65, 66 relative to the diaphragm portion 64, for example, of the diaphragm element 66 (FIG. 7*b*), the screen 67 air outlet openings corresponding to the direction of displacement are closed, so that air is allowed to pass only through respective apertures 32, causing the exiting air stream to be directed at selected hair regions. In the present embodiment, the force acting during the combing or brushing action on the brush member, that is, the supporting structure 30, and the resultant displacement of the diaphragm element 66 have the effect that air is passed through those apertures 32 that lie ahead of the combing and brushing direction. When the combing or brushing direction is changed, the diaphragm element 65 is displaced (not shown), causing the respective other air outlet openings of the screen 67 to be covered. Again, the air stream passes through the forward lying apertures 32 of the supporting structure 30. As this occurs, the air exiting from the apertures 32 strikes the scalp tangentially, thus supporting the combing or brushing motion in addition to preferably also having a smoothing effect on the hair regions aerated during the drying operation. Moreover, this tangential air stream practically precludes overheating of the scalp.

Similar to the embodiment previously described, the supporting structure 30 is adapted to be secured to the housing 12 by means of a locking device, being yet demountable for cleaning purposes or for substituting other supporting structures as, for example, those having a different number of apertures and/or variable brush members.

We claim:

1. An air-moving appliance for styling hair, comprising a housing having an air inlet opening and an air moving means and an air outlet opening, a supporting structure, the supporting structure supporting a plurality of hair pickup means and being provided with a plurality of apertures fluidly communicable with the air outlet opening, the supporting structure being attachable to the housing at the air outlet opening, and a diaphragm device provided at the air outlet opening in operative engagement with the supporting structure, wherein the supporting structure is displaceable relative to the diaphragm device by a force exerted on the hair pickup means in engagement with hair of a user, whereby when the supporting structure is displaced a first portion of the apertures of the supporting structure is at least partially prevented by the diaphragm device from fluid communication with the air outlet opening and a second portion of the apertures is in fluid communication with the air outlet opening.

2. The appliance as claimed in claim 1 wherein the hair pickup means comprises brush bristles.

3. The appliance as claimed in claim 1 wherein the hair pickup means comprises comb teeth.

4. The appliance as claimed in claim 1, further comprising a spring means biasing the supporting structure relative to the diaphragm device to a first position.

5. The appliance as claimed in claim 1, wherein in a first position of the supporting structure the supporting structure is not displaced relative to the diaphragm device and the first and second portions of the apertures are in fluid communication with the air outlet opening.

6. The appliance as claimed in claim 1, wherein the supporting structure is pivotally mounted on the housing about a pivot axis.

7. The appliance as claimed in claim 1, wherein the diaphragm device is fixedly retained on the housing.

8. The appliance as claimed in claim 7, wherein the diaphragm device forms a screen for the air outlet opening.

9. The appliance as claimed in claim 1, wherein the supporting structure is releasably attached to the housing.

10. The appliance as claimed in claim 1, wherein the housing further comprises a locking device to immovably secure the supporting structure.

11. The appliance as claimed in claim 1, wherein the supporting structure further comprises an air directing device for directing air exiting from the air outlet opening towards the apertures.

12. The appliance as claimed in claim 1, wherein the supporting structure is mounted for translating movement on the housing.

13. An air-moving appliance for styling hair, comprising a housing having an air inlet opening and an air moving means and an air outlet opening, a supporting structure, the supporting structure supporting a plurality of hair pickup means and being provided with a plurality of apertures fluidly communicable with the air outlet opening, the supporting structure being attachable to the housing at the air outlet opening, and a diaphragm device in fluid communication with the air outlet opening, the diaphragm device comprising at least two diaphragm elements movable independently of each other and in operative engagement with each other by a spring means, wherein the at least two diaphragm elements are in operative engagement with the supporting structure, and wherein the supporting structure is displaceable relative to the housing by a force exerted on the hair pickup means in engagement with hair of a user, whereby when the supporting structure is displaced a first portion of the apertures of the supporting structure is at least partially prevented by at least one of the at least two diaphragm elements from fluid communication with the air outlet opening and a second portion of the apertures is in fluid communication with the air outlet opening.

14. The appliance as claimed in claim 13 wherein the hair pickup means comprises brush bristles.

15. The appliance as claimed in claim 13 wherein the hair pickup means comprises comb teeth.

16. The appliance as claimed in claim 13, wherein the at least two diaphragm elements are provided on the supporting structure and displaceable relative to the supporting structure and relative to the housing.

17. The appliance as claimed in claim 13, wherein the supporting structure further comprises at least two engaging means and the housing further comprises at least two abutment means, the engaging means and the abutment means camming at least one of the movable diaphragm elements at a time in alternate and opposite motion in the direction of displacement of the supporting structure.

18. The appliance as claimed in claim 13, wherein the diaphragm device further comprises a diaphragm portion fixedly retained on the housing forming a screen for the air outlet opening.

19. The appliance as claimed in claim 13, wherein the supporting structure is releasably attached to the housing.

20. The appliance as claimed in claim 13, wherein the housing further comprises a locking device to immovably secure the supporting structure.

21. The appliance as claimed in claim 13, wherein each diaphragm element further comprises an air directing device for directing air exiting from the air outlet opening towards the apertures.

22. The appliance as claimed in claim 13, wherein the supporting structure is pivotally mounted on the housing.

23. The appliance as claimed in claim 13, wherein the supporting structure is mounted for translating movement on the housing.

24. An air-moving appliance for styling hair, comprising a housing having an air inlet opening and an air moving means and an air outlet opening, a supporting structure, the supporting structure supporting a plurality of hair pickup means and being provided with a plurality of apertures, the supporting structure being attachable to the housing at the air outlet opening, and a diaphragm device disposed between the supporting structure and the air outlet opening, the diaphragm device comprising a diaphragm fixed portion fixedly located on the housing and at least one independently movable diaphragm element adjacent the fixed diaphragm portion, wherein the diaphragm fixed portion includes a plurality of air exit openings fluidly communicable with the air outlet opening and with the plurality of apertures of the supporting structure, wherein the at least one diaphragm element is in operative engagement with the supporting structure, and wherein the supporting structure is displaceable relative to the housing by a force exerted on the hair pickup means in engagement with hair of a user, whereby when the supporting structure is displaced a first portion of the air exit openings of the diaphragm fixed portion is at east partially prevented by the at least one movable diaphragm element from fluid communication with the air outlet opening and a second portion of the air exit openings of the diaphragm fixed portion is in fluid communication with the air outlet opening.

25. The appliance as claimed in claim 24 wherein the hair pickup means comprises brush bristles.

26. The appliance as claimed in claim 24 wherein the hair pickup means comprises comb teeth.

27. The appliance as claimed in claim 24, wherein the diaphragm fixed portion forms a screen for the air outlet opening.

28. The appliance as claimed in claim 24, wherein the diaphragm device comprises at least two diaphragm elements movable independently of each other.

29. The appliance as claimed in claim 28, wherein the at least two diaphragm elements are in operative engagement by a spring means.

30. The appliance as claimed in claim 28, wherein the diaphragm elements are provided on the diaphragm fixed portion and displaceable relative to the diaphragm fixed portion as well as relative to the supporting structure.

31. The appliance as claimed in claim 28 wherein the supporting structure further comprises at least two engaging means and the diaphragm fixed portion further comprises at least two abutment means, the engaging means and the abutment means camming at least one of the movable diaphragm elements at a time in alternate and opposite motion in the direction of displacement of the supporting structure.

32. The appliance as claimed in claim 24, wherein the supporting structure is releasably attached to the housing.

33. The appliance as claimed in claim 24, wherein the housing further comprises a locking device to immovably secure the supporting structure.

34. The appliance as claimed in claim 24, wherein the at least one movable diaphragm element further comprises an air directing device for directing air exiting from the air exit openings towards the apertures.

35. The appliance as claimed in claim 24, wherein the supporting structure is pivotally mounted on the housing.

36. The appliance as claimed in claim 24, wherein the supporting structure is mounted for translating movement on the housing.

37. An implement for styling hair for an air-moving appliance having a housing and an air outlet opening, the implement comprising a supporting structure attachable to the housing at the air outlet opening, the supporting structure supporting a plurality of hair pickup means and being provided with a plurality of apertures fluidly communicable with the air outlet opening, and a diaphragm device provided on the supporting structure in operative engagement with the supporting structure, wherein the supporting structure is displaceable relative to the diaphragm device by a force exerted on the hair pickup means engaged with hair of a user in use, whereby when the supporting structure is displaced a first portion of the apertures is at least partially prevented by the diaphragm device from fluid communication and a second portion of the apertures is not substantially prevented from fluid communication.

38. The implement as claimed in claim 37, further comprising a spring means biasing the supporting structure relative to the diaphragm device to a first position.

39. The implement as claimed in claim 37, wherein the supporting structure is pivotally mounted with respect to the diaphragm device.

40. The implement as claimed in claim 37, wherein the supporting structure is mounted for translating movement with respect to the diaphragm device.

41. An implement for styling hair for an air-moving appliance having a housing and an air outlet opening, the implement comprising a supporting structure attachable to the housing at the air outlet opening, the supporting structure supporting a plurality of hair pickup means and being provided with a plurality of apertures fluidly communicable with the air outlet opening, and a diaphragm device provided on the supporting structure and comprising at least two diaphragm elements movable independently of each other and in operative engagement with each other by a spring means, wherein the at least two diaphragm elements are in operative engagement with the supporting structure, and wherein the supporting structure is displaceable relative to the movable diaphragm elements by a force exerted on the hair pickup means engaged with hair of a user in use, whereby when the supporting structure is displaced a first portion of the apertures is at least partially prevented by the at least two diaphragm elements from fluid communication and a second portion of the apertures is not substantially prevented from fluid communication.

42. The implement as claimed in claim 41, wherein the supporting structure is pivotally mounted with respect to the diaphragm device.

43. The appliance as claimed in claim 41 wherein the hair pickup means comprises brush bristles.

44. The appliance as claimed in claim 41 wherein the hair pickup means comprises comb teeth.

45. The implement as claimed in claim 41, wherein the supporting structure is mounted for translating movement with respect to the diaphragm device.

46. A method for styling a selected part of the hair of a user comprising the steps of:

providing, on an air moving appliance for personal use including a housing and an air outlet opening, a supporting structure supporting a plurality of hair pickup means and being provided with a plurality of air exit apertures, the supporting structure being attached to the housing at the air outlet opening and displaceable relative to the housing, and a diaphragm fluidly communicable with the air outlet opening and with the apertures, the diaphragm being in operative engagement with the supporting structure;

engaging at least a portion of the plurality of hair pickup means with the hair of the user;

moving the air moving appliance in a first direction of travel relative to the selected part of the hair of the user;

displacing the supporting structure relative to the housing by a force exerted on the portion of the plurality of hair pickup means engaged with the hair of the user;

preventing substantially a flow of air exiting a first portion of the air exit apertures; and exhausting a flow of air from a second portion of the air exit apertures, whereby a flow of exhausted air is directed towards the selected part of the hair.

47. The method of claim 46 wherein the step of providing further comprises providing hair pickup means comprising brush bristles.

48. The method of claim 46 wherein the step of providing further comprises providing hair pickup means comprising comb teeth.

49. The method of claim 46 further comprising the step of biasing the supporting structure relative to the housing.

50. The method of claim 46 wherein the step of displacing the supporting structure comprises rotating the supporting structure relative to the housing.

51. The method of claim 46 wherein the step of exhausting the flow of air further comprises exhausting the flow of air from the second portion of the air exit apertures in a direction substantially tangential to the scalp or skin of the user adjacent the selected part of the hair.

52. The method of claim 46 wherein the step of exhausting the flow of air further comprises exhausting at least partially in the first direction of travel the flow of air from the second portion of the air exit apertures.

53. The method of claim 46 wherein the step of exhausting the flow of air further comprises exhausting in a direction at least partially opposite the first direction of travel the flow of air from the second portion of the air exit apertures.

54. The method of claim 46 wherein the step of displacing the support structure comprises translating the supporting structure relative to the housing.

* * * * *

UNITED STATES PATENT AND TRADEMARK OFFICE

CERTIFICATE OF CORRECTION

PATENT NO. : 5,546,674
DATED : August 20, 1996
INVENTOR(S) : Klaus-Peter Lange, et al.

It is certified that error appears in the above-indentified patent and that said Letters Patent is hereby corrected as shown below:

Column 1, line 42, change "face" to --force--.
Column 9: Claim 24, line 58, change "east" to --least--.
Column 10: Claim 37, line 50, delete "substantially".
Column 10: Claim 41, at column 11, line 12, delete "substantially".

Signed and Sealed this

Twenty-first Day of January, 1997

*Attest:*

Bruce Lehman

BRUCE LEHMAN

*Attesting Officer*

*Commissioner of Patents and Trademarks*